US006293330B1

(12) United States Patent
Ciuca

(10) Patent No.: US 6,293,330 B1
(45) Date of Patent: Sep. 25, 2001

(54) UNIVERSAL HEAD RAIL

(75) Inventor: Zazu Ciuca, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/383,882

(22) Filed: Aug. 26, 1999

(51) Int. Cl.[7] ..... E06B 9/30
(52) U.S. Cl. ..... 160/176.1 R; 160/902
(58) Field of Search ..... 160/168.1 R, 176.1 R, 160/177 R, 902, 405

(56) References Cited

U.S. PATENT DOCUMENTS

| | | | | |
|---|---|---|---|---|
| 4,079,770 | | 3/1978 | Woodle . | |
| 4,262,728 | | 4/1981 | Debs . | |
| 4,384,605 | | 5/1983 | Schaeffer et al. . | |
| 4,425,956 | | 1/1984 | Terlecke . | |
| 4,947,921 | * | 8/1990 | Chun-cheng | 160/176.1 R |
| 4,955,419 | | 9/1990 | Morris . | |
| 5,092,387 | * | 3/1992 | King et al. | 160/176.1 R |
| 5,109,909 | * | 5/1992 | Hong | 160/168.1 R |
| 5,472,035 | * | 12/1995 | Biba et al. | 160/168.1 R |
| 5,533,560 | * | 7/1996 | Morris | 160/902 X |
| 5,553,649 | * | 9/1996 | Chisaka et al. | 160/168.1 R |
| 5,680,892 | * | 10/1997 | Liu | 160/177 R |
| 5,749,405 | | 5/1998 | Huang . | |

* cited by examiner

*Primary Examiner*—David M. Purol
(74) *Attorney, Agent, or Firm*—Foley & Lardner

(57) ABSTRACT

A universal head rail assembly includes a front wall and a back wall, wherein the front wall includes a first contour formed on an outer face thereof and the back wall includes a second contour formed on an outer face thereof. A reversible rotator assembly includes a tilt control wand coupled to a gear box configured to selectively rotate a rotator element. The reversible rotator assembly and the tilt control wand are in a first position when the first contour of the front wall is displayed and the reversible rotator assembly and the tilt control wand are in a second position when the second contour of the back wall is displayed. The gear box includes a first universal socket coupled to a gear train positioned on an opposed side of the head rail from a second universal socket that is coupled to the gear train. The first and second sockets each are configured to receive a first end of the tilt control wand that matingly engages the gear train, thereby rotating the gear train and the rotator element to pivot the slats between opened and closed positions.

3 Claims, 4 Drawing Sheets

FIG. 7
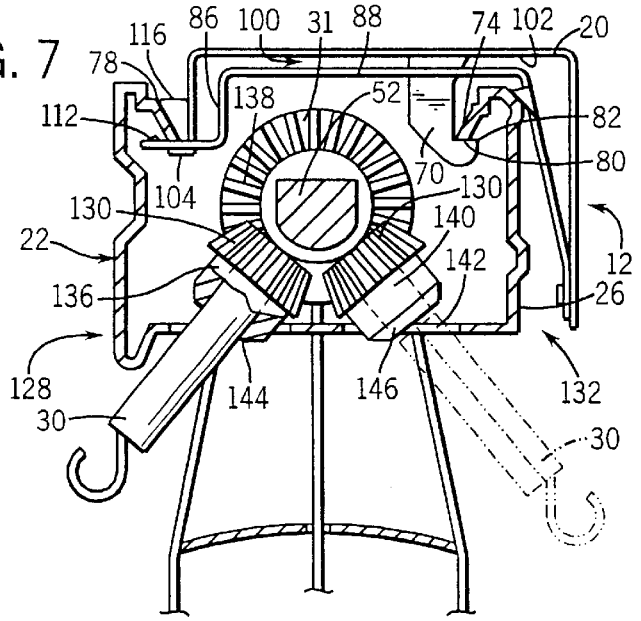
FIG. 8
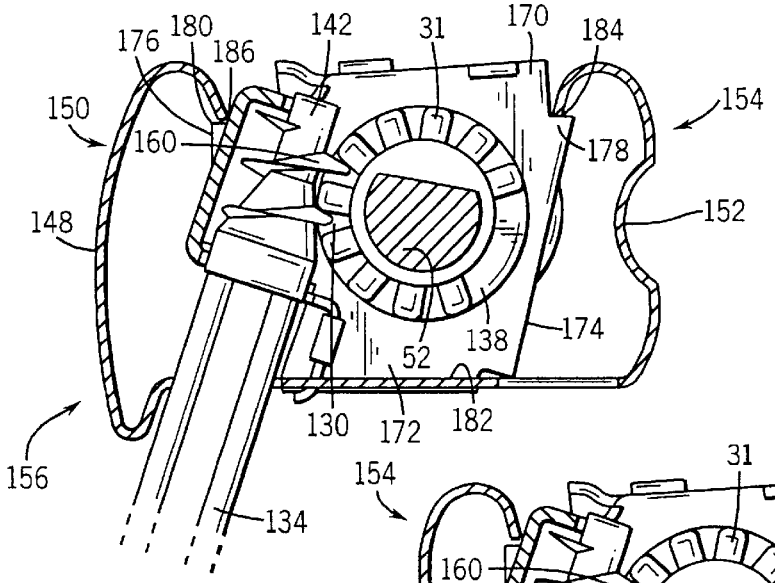
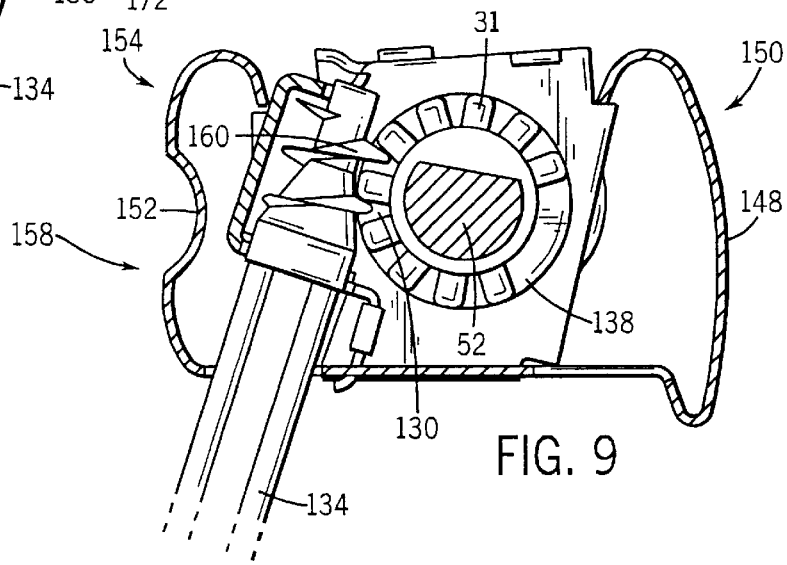
FIG. 9

UNIVERSAL HEAD RAIL

FIELD OF THE INVENTION

The present invention relates generally to the art of window coverings and more particularly to mini blind head rails.

BACKGROUND OF THE INVENTION

Mini blinds have been known and used for many years for the selective admission of light into a room and for privacy. Typically, mini blinds are installed at a window opening and include a plurality of slats that can be pivoted between an open horizontal position and a closed, nearly vertical position.

A conventional mini blind includes a head rail mounted to head rail supports that are positioned near the top of the window opening. The head rail generally has a U-shaped cross-section with an open interior for receiving the various components that control the pivotable slats. The head rail also includes a number of apertures for access to the various control components, e.g., flexible ladders, basket assemblies, drawcord assemblies and a tilt control wand.

The flexible ladders which support the pivotable slats are usually connected to the basket assemblies through appropriate aperatures in the bottom of the head rail. Additionally, access holes are provided for the pullcord which raises and lowers the bottom rail and the slats, and for the tilt control wand used to control the tilter bar. The basket assemblies, in turn, facilitate control of the flexible ladders which allow the slats to pivot between open and closed positions.

The basket assemblies generally include a framework which rests within the open interior of the head rail and a rotator element to which the flexible ladders are attached. The ladders each have two flexible strings which are suspended from this rotating element with the strings being connected over opposed sides of the rotating element. Thus, when the rotator element is rotated in one direction, one string will be lowered while the other string is raised, and the opposite result is achieved when the element is rotated in the opposite direction. Each ladder also includes a plurality of cross links connected between the two strings. The slats are positioned over these cross links along the length of the ladders. When the rotator elements are rotated, the slats are pivoted as one end of each cross link is pulled upwards while the other end of each cross link is lowered.

To ensure that each ladder and its respective cross links are pivoted the same amount, a tilter bar is connected to a gearbox at one end of the head rail which, in turn, is connected through an appropriate aperture in the head rail to the tilt control wand. Thus, a person may rotate the tilter bar by rotating the wand which pivots the slats to a position that allows total privacy or the desired amount of light to pass through the mini blind.

In current mini blind systems, various contours are fitted to the front face of the head rails for different designs. Unfortunately, with the current systems, only one display contour can be formed on the front face of the head rail. The complexity of the components, including the basket assemblies to tilt the slats, prohibits turning the head rail around to display a second contour formed on the back face of the head rail. Consequently, mini blind manufacturers are restricted to manufacturing head rails with only a single "good" or display face.

It is therefore desirable to provide a universal head rail that would permit manufacturers to form two display contours at one time on both the front and back faces of the head rail. It would further be desirable to design a universal head rail having the tilt control wand on either the right side or the left side of the head rail regardless of the contour being displayed.

SUMMARY OF THE INVENTION

A universal head rail assembly in accordance with one aspect of the present invention comprises a head rail including a front wall and a back wall, wherein the front wall includes a first contour formed on an outer face thereof and the back wall includes a second contour formed on an outer face thereof. A reversible rotator assembly includes a tilt control wand coupled to a gear box configured to selectively rotate a rotator element. The reversible rotator assembly and the tilt control wand are in a first position when the first contour of the front wall is displayed and the reversible rotator assembly and the tilt control wand are in a second position when the second contour of the back wall is displayed.

In accordance with another aspect of the present invention, a method for displaying different contours formed on a head rail comprise the steps of forming a first contour on an outer face of a front wall of a head rail, forming a second contour on an outer face of a back wall of the head rail, and mounting a reversible rotator assembly, including a tilt control wand coupled to a gear box configured to selectively rotate a rotator element, in a first position when the first contour of the front wall is displayed and mounting the reversible rotator assembly and the tilt control wand in a second position when the second contour of the back wall is displayed.

Yet another aspect of the present invention is a universal head rail system comprising a head rail including a front wall and a back wall, wherein the front wall includes a first contour formed on an outer face thereof and the back wall includes a second contour formed on an outer face thereof. A universal bracket is configured to attach the head rail to a wall. The universal head rail system further comprises means for suspending a plurality of slats from the head rail, means for raising and lowering the slats, and means for pivoting the slats between a substantially open position and a substantially closed position. The pivoting means includes a plurality of support strings connected to the slats. The pivoting means is arranged in a first position when the first contour of the front wall is displayed and in a second position when the second contour of the back wall is displayed.

Other principal features and advantages of the invention will become apparent to those skilled in the art upon review of the following drawings, the detailed description and the appended claims.

BRIEF DESCRIPTION OF THE DRAWINGS

The preferred exemplary embodiment of the invention will hereinafter be described in conjunction with the appended drawings, wherein like numerals denote like elements and:

FIG. 7 is a cross-sectional view of a reversible rotator assembly according to the present invention;

FIG. 8 is a cross-sectional view of a tilt control wand engaging a gear box when a first contour of the front face of the head rail is displayed; and FIG. 9 is a cross-sectional view of a tilt control wand engaging a gear box when a second contour of the back face of the head rail is displayed.

DETAILED DESCRIPTION OF A PREFERRED EXEMPLARY EMBODIMENT

Figure 1:
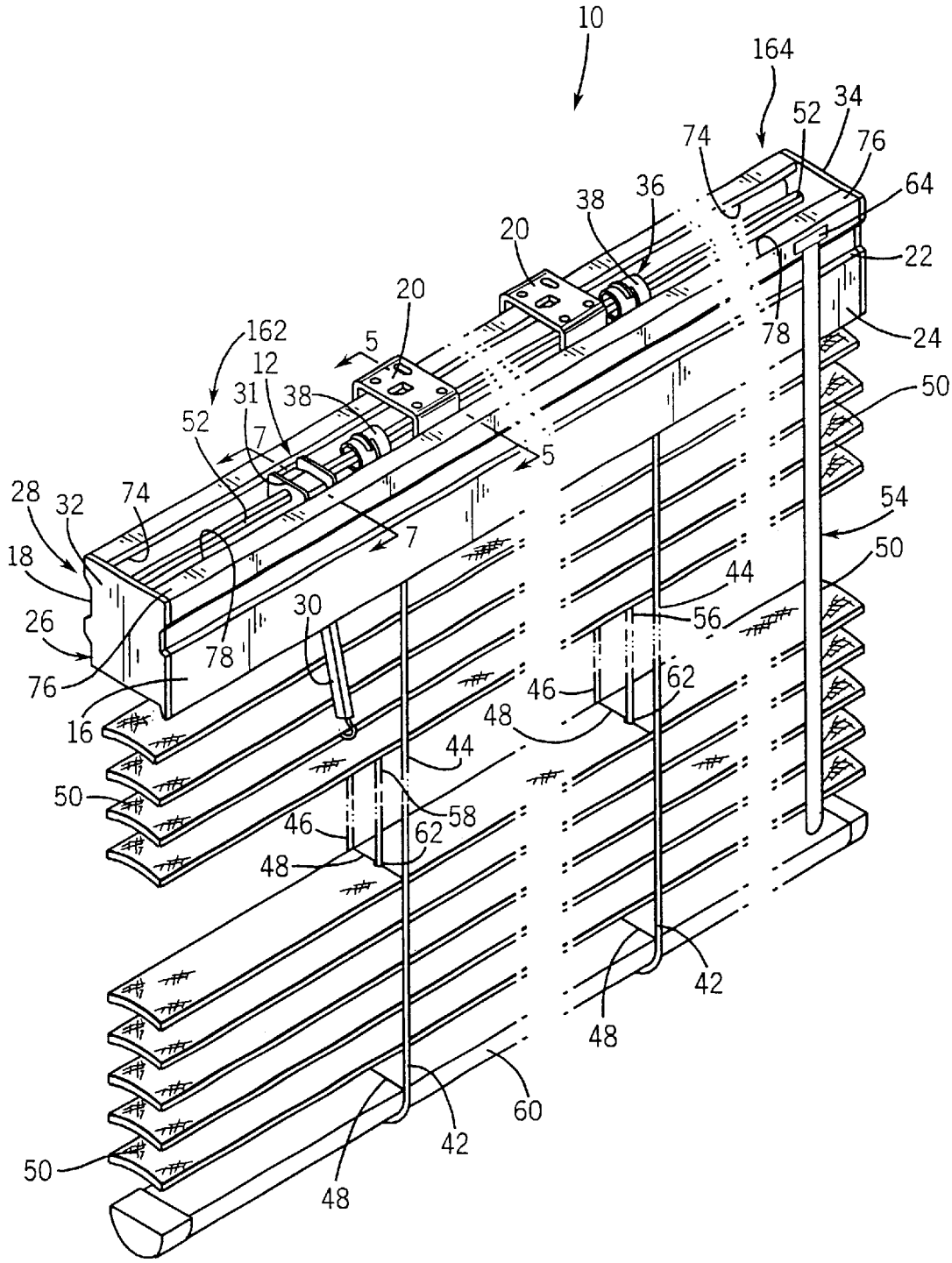
FIG. 1 is a perspective view of a mini blind system according to the preferred form of the present invention illustrating the overall layout of the components.

Referring generally to FIG. 1, a mini blind system 10 according to the present invention includes a reversible rotator assembly 12, a head rail 14 having a front wall 16 and a back wall 18, and a universal mounting bracket 20. Front wall 16 includes a first contour 22 formed on an outer face 24 thereof and back wall 18 includes a second contour 26 formed on an outer face 28 thereof. Reversible rotator assembly 12 includes a tilt control wand 30 coupled to a gear box 31.

Head rail 14 is mounted near the top of a window opening between a pair of head rail supports 32, 34. As will be appreciated by those skilled in the art, other support structures, including supports intermediate the ends 32 and 34, could also be employed. Head rail 14 has a generally U-shaped cross-section, at least one basket assembly 36 and preferably two or more basket assemblies depending on the length of head rail 14. Each basket assembly 36 includes a rotator element 38 mounted within a basket frame 40.

A flexible ladder 42 is suspended from each rotator element 38. Each flexible ladder 42 includes a front support string 44 and a back support string 46 connected to each other by a plurality of cross links 48. Pivotable slats 50 are spaced apart from one another and are supported by cross links 48 as is well-known in the art. The uppermost cross link is typically a rigid slat clip which is attached to the uppermost slat. Thus, the uppermost slat rests on cross links 48 while front support string 44 of each flexible ladder 42 is disposed on the front side of slats 50 and back support string 46 is disposed on the back side of slats 50. Support strings 44 and 46 are similarly connected to the front and back side of each rotator element 38 so that when rotator elements 38 are rotated in a first direction, front support string 44 will move downwardly while back support string 46 will move upwardly to pivot cross links 48 and slats 50. When rotator elements 38 are rotated in a second direction, back support string 46 will move downwardly while front support string 44 will move upwardly to pivot slats 50 in the opposite direction. In this manner, slats 50 may be pivoted between a fully open (horizontal) and a fully closed (vertical) position.

A tilter bar 52 extends through each rotator element 38, thereby ensuring each rotator element 38 rotates simultaneously and by the same amount. Tilter bar 52 is connected to gear box 32 which, in turn, is connected to tilt control wand 30.

Additionally, slats 50 may be raised or lowered in the window opening by a drawcord 54. Drawcord 54 includes one or more drawstrings 56 and 58 secured to a bottom rail 60 disposed beneath the lowermost of slats 50. From bottom rail 60, draw strings 56 and 58 extend up through axially aligned holes 62 in slats 50, through basket assemblies 36, over rotator elements 38 and along the interior of head rail 14 to a drawstring opening 64. Rotator elements 38 facilitate the movement of drawstrings 56 and 58. A locking mechanism which may be of conventional design is disposed within drawstring opening 64 to selectively lock drawstrings 56 and 58. By pulling on drawcord 54, bottom rail 60 may be raised and lowered to any position the user desires and locked into the desired location using the conventional locking mechanism as is well-known in the art.

Figure 2:
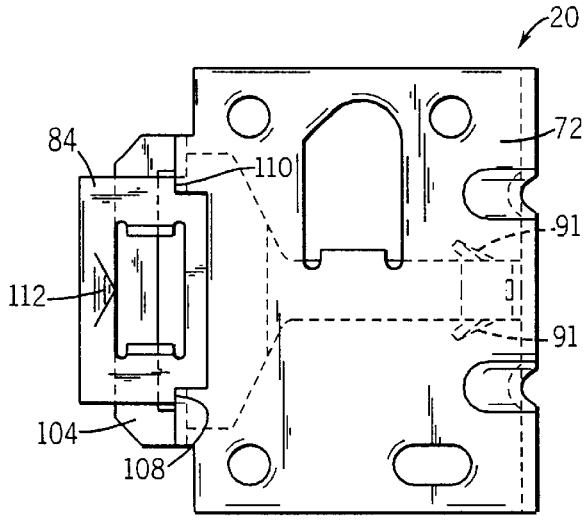
FIG. 2 is a top planar view of a universal bracket according to the preferred form of the present invention.
Figure 3:
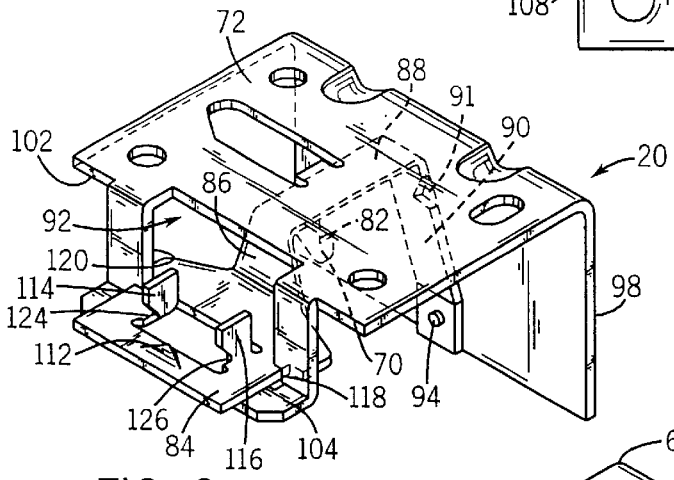
FIG. 3 is a perspective view of the universal bracket.
Figure 4:
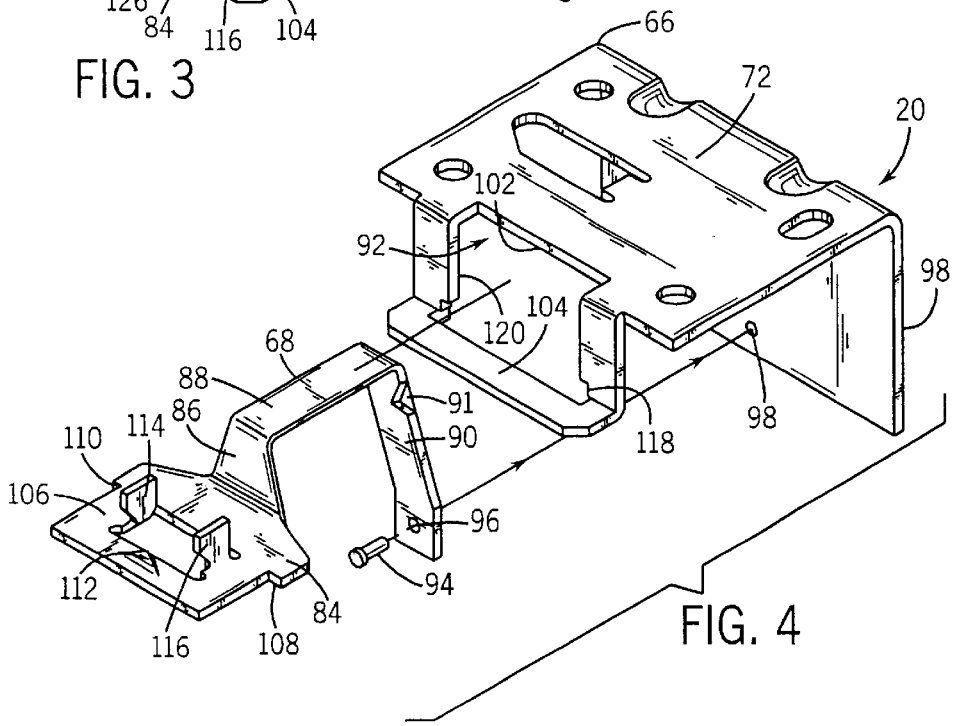
FIG. 4 is an exploded view of the components of the universal bracket.
Figure 5:
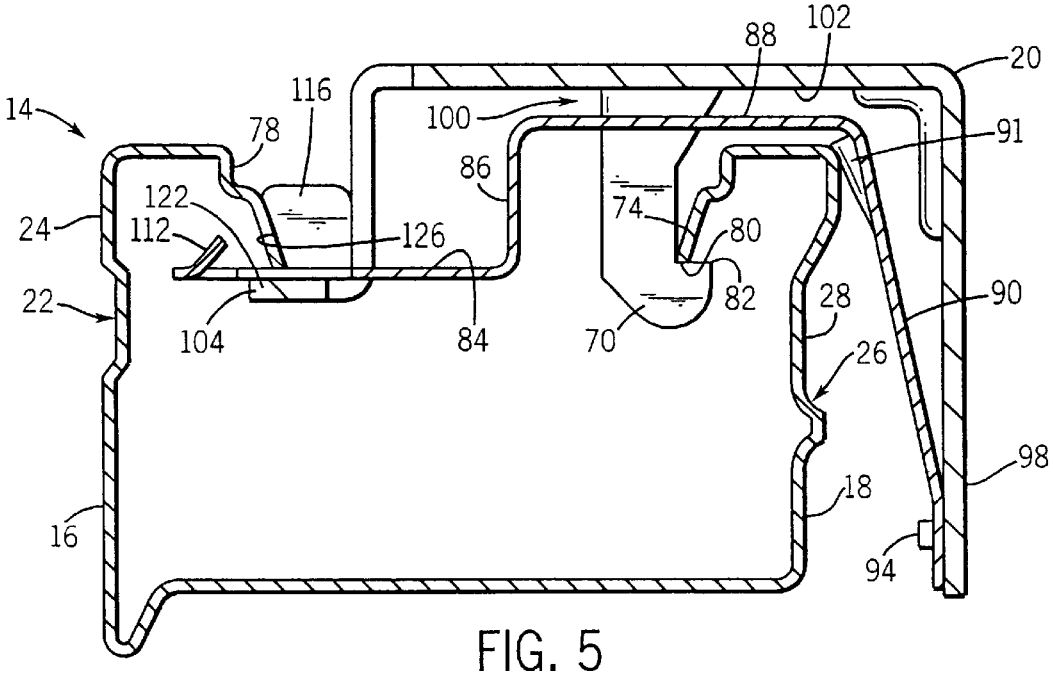
FIG. 5 is a cross-sectional view of the mini blind system including the head rail according to the present invention taken generally along the line 5–5 of FIG. 1.

As illustrated in FIGS. 2–4, universal bracket 20 is configured to attach head rail 14 to a wall. Universal bracket 20 includes a mounting assembly 66 configured to receive an interlocking element 68. A notch 70 protrudes downwardly from a top surface 72 of mounting assembly 66. Head rail 14 further includes a first lip 74 formed along the length of a top surface 76 of head rail 14 and a second lip 78 formed along the length of top surface 76 (FIG. 1). Notch 70 engages first lip 74 to support back wall 18 of head rail 14. As illustrated in FIG. 5, a bottom surface 80 of back wall 18 rests on a support surface 82 of notch 70.

Interlocking element 68 includes a shelf 84, a front wall 86, a top wall 88 and a back wall 90. Back wall 90 slides through aperture 92 formed in mounting assembly 66 and is secured to mounting assembly 66 with a screw 94 placed through a first hole 96 formed in back wall 90 of interlocking element 68 and a second hole 98 formed in a back wall 98 of mounting assembly 66. Top wall 88 of interlocking element 68 forms a channel 100 with an inside surface 102 of mounting assembly 66. Finally, a support shelf 104 formed in mounting assembly 66 supports shelf 84 of interlocking element 68. Shelf 84 of interlocking element 68 includes a base plate 106 having a first indentation 108 and a second indentation 110, a raised surface 112, and a pair of flanges 114 and 116 protruding upwardly from base plate 106.

Figure 6:
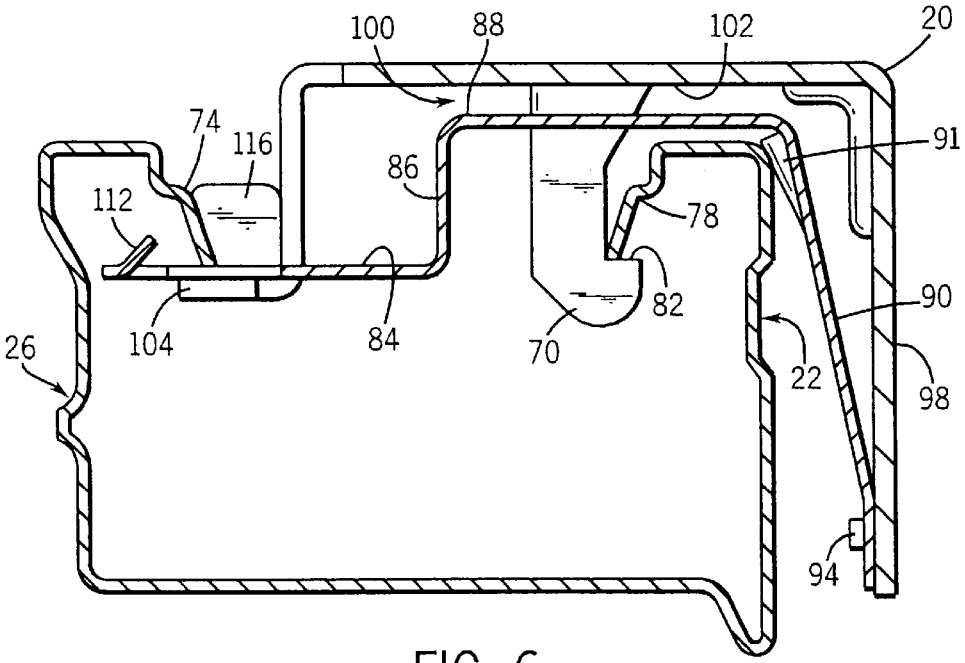
FIG. 6 is a cross-sectional view of the mini blind system including the head rail of FIG. 5, wherein the front contour and the back contour of the head rail are reversed.

Shelf 84 of interlocking element 68 extends beyond support shelf 104 of mounting assembly 66. When interlocking element 68 engages mounting assembly 66, first indentation 108 abuts a first inside surface 118 of mounting assembly 66 and second indentation 110 abuts a second inside surface 120 of mounting assembly 66. As illustrated in FIGS. 3 and 5, a bottom surface 122 of second lip 78 of front wall 16 is secured in place between raised surface 112 and flanges 114 and 116. Flanges 114 and 116 include a pair of recesses 124 and 126, respectively, that matingly engage bottom surface 122 of front wall 16. As illustrated in FIG. 6, universal bracket 20 functions to support head rail 14 regardless of whether first contour 22 or second contour 26 of head rail 14 is displayed. In FIGS. 1 and 5, first contour 22 is displayed, whereas second contour 26 is displayed in FIG. 6.

The first contour surface 22 of headrail 14 is displayed by attaching bottom surface 80 of back wall 18 on support surface 82 of notch 70. In order to place bottom surface 80 on back wall 18, a user must first push back wall 90 of interlocking element toward back wall 98 of mounting assembly 66. Back wall 90 flexes proximate attachment 94, such that interlocking element 88 slides on support shelf 1 04 toward back wall 98 of mounting assembly. Once the top portion of the rear contour clears notch 70, surface 80 is supported on support shelf 82. Back wall 90 then resiliently pushes the rear contour toward the notch 70 with a pair the pair of detents 91 (See FIGS. 2, 3, AND 5). The detents help to maintain the headrail from moving along its longitudinal axis.

As illustrated in FIG. 7, reversible rotator assembly 12 is configured to selectively rotate rotator elements 38. Wand 30 is coupled to gear box 31 in a first position 128 when first contour 22 of head rail 14 is displayed. Conversely, wand 30 is coupled to gear box 31 in a second position 132 when second contour 26 of head rail 14 is displayed. In order to display different head rail designs, first contour 22 is different than second contour 26.

Rotator assembly 12 includes gear box 31, a first universal socket 136 coupled to a gear train 138 and positioned on an opposed side of head rail 14 from a second universal socket 140. Second universal socket 140 is likewise coupled to gear train 138 opposite first universal socket 136. First and second sockets 136 and 140 are each configured to receive a first end 142 of tilt control wand 30. Wand 30 matingly snap fits into either an opening 144 of first universal socket 136 or an opening 146 of second universal socket 140.

In operation, a plurality of threads 130 formed on the outer surface of universal sockets 136 and 140 matingly engage gear train 138. Rotation of wand 30 thereby causes rotation of gear train 138 which, in turn, causes rotation of tilter bar 52, thereby rotating rotator elements 38 and causing slats 50 to pivot between open and closed positions.

After forming contours 22 and 26, the manufacturer chooses whether first contour surface 22 or second contour surface 26 will be displayed. Regardless of which contour is chosen, the manufacturer does not have to reposition reversible rotator assembly 12 in order to properly attach tilt control wand 30 into either first universal socket 136 or second universal socket 140. Tilt control wand 30 is snap fit into the universal socket corresponding to the displayed contour so that wand 30 is in front of slats 50, thereby allowing a user to rotate slats 50 with wand 30.

An alternative embodiment of a mini blind system, as illustrated in FIGS. 8 and 9, includes a tilt control wand 134 and a head rail having a first contour surface 148 formed on outer face 150 and a second contour surface 152 formed on an outer face 154 of the head rail. Tilt control wand 134 is coupled to gear box 31 and mounted in a first position 156 when first contour surface 148 is displayed (FIG. 8). Conversely, tilt control wand 134 is coupled to gear box 31 and mounted in a second position 158 when second contour surface 152 is displayed. Tilt control wand 134 snap fits into a threaded head 160 that matingly engages threads 130 in gear box 31. Threaded heads 160 are positioned on opposed sides of gear box 31 and rotation of wand 134 causes rotation of gear train 138 which, in turn, causes rotation of tilter bar 52, thereby rotating rotator elements 38 and causing slats 50 to pivot between open and closed positions.

While the present invention has been described with certain Figures representing a particularly preferred embodiment, the invention is not to be limited thereby but is to be limited solely by the scope of the claims which follow. For example, mini blind system 10 may also include an adjustable mounting means for mounting rotator assembly 12 in a first position at a first end 162 of head rail 14 when one of first contour 22 or second contour 26 is displayed, and mounting rotator assembly 12 in a second position at a second end 164 of head rail 14 when the other of first contour 22 or second contour 26 is displayed (FIG. 1). As illustrated in FIG. 8, the adjustable mounting means for mounting rotator assembly 12 includes a rotator assembly housing 170 having a base 172, a first beveled side 174, and a second beveled side 176. Each side 174, 176 includes a flat portion 178, 180 respectively. The rotator assembly housing 170 is secured within headrail 14, with base 172 of the housing 170 resting against a base 182 of headrail 14, and the flat portions 178, 180 biased against the edges 184, 186 of first and second contours 148, 152. Mounting rotator assembly 12 at either first end 162 or second end 164 of head rail 14 allows manufacturers to maintain the position of tilt control wand 30 on the same side of head rail 14 regardless of the contour being displayed (e.g., always position wand 30 in front of slats 50 on left side of head rail 14 (first end 162) regardless of the contour being displayed).

What is claimed is:

1. A universal head rail assembly, comprising:

a head rail including a front wall and a back wall, wherein the front wall includes a first contour formed on an outer face thereof and the back wall includes a second contour formed on an outer face thereof;

a reversible rotator assembly including a tilt control wand coupled to a gear box configured to selectively rotate a rotator element, wherein the reversible rotator assembly and the tilt control wand are in a first position when the first contour of the front wall is displayed and the reversible rotator assembly and the tilt control wand are in a second position when the second contour of the back wall is displayed, the gear box including a first universal socket coupled to a gear train positioned on a first side of the head rail, and a second universal socket coupled to the gear train on a second side of the head rail opposed from said first side, the first and second sockets each configured to receive a first end of the tilt control wand that matingly engages the gear train.

2. A method for displaying different contours formed on a head rail, comprising the steps of:

forming a first contour on an outer face of a front wall of a head rail and a second contour on an outer face of a back wall of the head rail; and mounting a reversible rotator assembly including a tilt control wand coupled to a gear box configured to selectively rotate a rotator element in a first position when the first contour of the front wall is displayed and mounting the reversible rotator assembly and the tilt control wand in a second position when the second contour of the back wall is displayed, the gear box including a first universal socket coupled to a gear train positioned on a first side of the head rail, and a second universal socket coupled to the gear train on a second side of the head rail opposed from said first side, the first and second sockets each configured to receive a first end of the tilt control wand that matingly engages the gear train.

3. A universal head rail system, comprising:

a head rail including a front wall and a back wall, wherein the front wall includes a first contour formed on an outer face thereof and the back wall includes a second contour formed on an outer face thereof;

a universal bracket configured to attach the head rail to a wall;

means for suspending a plurality of slats from the head rail;

means for raising and lowering the slats; and means for pivoting the slats between a substantially open position and a substantially closed position, the pivoting means including a plurality of support strings connected to the slats, wherein the pivoting means is arranged in a first position when the first contour of the front wall is displayed and the pivoting means is arranged in a second position when the second contour of the back wall is displayed, the gear box including a first universal socket coupled to a gear train positioned on a first side of the head rail, and a second universal socket coupled to the gear train on a second side of the head rail opposed from said first side, the first and second sockets each configured to receive a first end of the tilt control wand that matingly engages the gear train.

* * * * *